US007140313B2

(12) United States Patent
Neustat

(10) Patent No.: US 7,140,313 B2
(45) Date of Patent: Nov. 28, 2006

(54) ANTIQUING WHOLE CLOTH QUILT FABRIC

(76) Inventor: Paula S. Neustat, 10 London Ter., New City, NY (US) 10956

( * ) Notice: Subject to any disclaimer, the term of this patent is extended or adjusted under 35 U.S.C. 154(b) by 176 days.

(21) Appl. No.: 10/969,266

(22) Filed: Oct. 20, 2004

(65) Prior Publication Data

US 2006/0081164 A1 Apr. 20, 2006

(51) Int. Cl.
*D05B 11/00* (2006.01)
*D06F 35/00* (2006.01)

(52) U.S. Cl. ..... 112/475.08; 112/117; 8/147

(58) Field of Classification Search ..... 112/475.08, 112/420, 117, 2.1; 8/137, 147; 28/167, 169; 2/275; 428/102; 68/147
See application file for complete search history.

(56) References Cited

U.S. PATENT DOCUMENTS

| | | | | | |
|---|---|---|---|---|---|
| 2,103,587 | A * | 12/1937 | Lantz et al. | ..... | 8/496 |
| 3,523,749 | A * | 8/1970 | Reed et al. | ..... | 8/483 |
| 3,986,824 | A * | 10/1976 | Waibel et al. | ..... | 8/485 |
| 4,218,220 | A * | 8/1980 | Kappler et al. | ..... | 8/102 |
| 4,688,502 | A | 8/1987 | Krieger | | |
| 4,690,084 | A | 9/1987 | Krieger | | |
| 4,740,213 | A * | 4/1988 | Ricci | ..... | 8/108.1 |
| 5,653,770 | A * | 8/1997 | Goldstein et al. | ..... | 8/114 |
| 5,759,210 | A | 6/1998 | Potter et al. | | |
| 6,702,861 | B1 | 3/2004 | Trask et al. | | |
| 6,895,878 | B1 * | 5/2005 | Stutznacker | ..... | 112/117 |
| 2002/0133261 | A1 | 9/2002 | Fard | | |
| 2003/0196276 | A1 | 10/2003 | Trask et al. | | |

FOREIGN PATENT DOCUMENTS

| | | | |
|---|---|---|---|
| GB | 2069557 | * | 8/1981 |

* cited by examiner

*Primary Examiner*—Ismael Izaguirre

(57) ABSTRACT

Process for antiquing a quilt and resulting product includes providing a first fabric panel containing at least some of a first selected fiber, a second fabric panel containing at least some of a second selected fiber and a batting panel containing at least some of a third selected fiber. At least the first panel and its fiber is colored and susceptible to damage by washing. The three panels are layered and stitched together using thread of a fourth selected fiber and along a pattern to form a whole cloth quilt or fabric therefore can be used as is or as material for another product. Washing the quilt in a wet bath and with heat and agitation causes at least the first fabric panel to wear and fade and the quilt is then dried and has the antiqued appearance.

26 Claims, 4 Drawing Sheets

ANTIQUING WHOLE CLOTH QUILT FABRIC

FIELD AND BACKGROUND OF THE INVENTION

The present invention relates generally to the field of quilts and quilted or quilt fabrics (collectively called quilts here), and in particular to a new and useful process for giving a whole cloth quilt and whole cloth quilt fabrics a vintage or antique appearance, and to the new and useful quilt product itself.

Whole cloth quilts are defined as single panels of fabric or fabrics that have been seamed to produce the effect of a single panel on both the top and bottom surfaces of the quilt, and an intermediate layer of batting fabric between the two panels. The stitching of the quilt can be hand-done or machine-made with the effect of forming a sculptured outline of designs caused by the stitching pattern and the puffing of the batting underneath the fabric as it is confined to the spaces between the stitches.

There is a long history of whole cloth quilting in America, as it was one of the first quilting styles brought to this country. The original fabrics used in the $18^{th}$ century were wool for everyday or white cotton and white linen for more formal use. There was a renewal of interest in whole cloth quilts in the early twentieth century due to the growth in popularity of the sewing machine during that time period, and cotton sateen fabric was often used.

Excellent short articles on whole cloth history can be found on the Internet at:

www.womenfolk.com/quilting_history/wholecloth.htm and www.quilthistory.com/dating_quilts.htm.

Today, whole cloth quilts are stitched by hand or machine using cotton, linen, silk, wool, polyester or blends of any of these fibers. Many of these quilts are marketed with the puffed, sculptured effect of the stitch patterns as the primary appearance feature. Some of the quilts, after they are sewn, also undergo a finishing method to achieve a vintage look. The most popular method is for quilts using 100% cotton batting to be machine washed and dried. This method achieves a puckering of the fabric. The puckering is primarily due to the shrinkage of the cotton batting within the sewn space. With this process, the original smooth and sculptured effect is modified with a puckering giving a different appearance to the quilted fabric. Therefore, there are two different types of whole cloth quilt appearances with each look having its own proponents—the puffed, sculptured effect vs. the puckered effect.

An example of a whole cloth quilted sculptured look modified by the puckered effect in quilts can be seen in FIG. 1 which is a partial and schematic illustration of a pattern for a whole cloth quilt that can be antiqued according to the present invention.

Patents that are relevant to the present invention include U.S. Pat. No. 4,690,084 for Production of Puffed Embroidered Design Fabrics, U.S. Pat. No. 4,688,502 for Puffed Embroidered Design Fabrics, U.S. Pat. No. 6,702,861 for a Process for Antiquing Fabric, U.S. Published Patent Application 2003/0196276 for a Process for Antiquing Fabric, U.S. Published Patent Application 2002/0133261 for a Method and System for Producing Garments Having a Vintage Appearance, and U.S. Pat. No. 5,759,210 to Potter, et al. for a Lyocell Fabric Treatment to Reduce Fibrillation Tendency.

SUMMARY OF THE INVENTION

It is an object of the present invention to provide a process for antiquing a quilt which artificially makes the quilt appear faded and worn, and the quilt itself. The term "quilt," as used here is meant to include quilt fabrics and quilted fabrics that may be used alone or combination with other quilt or quilted fabrics to make a completed quilt. Also within the meaning of the term "quilt," as used here, are any and all quilted fabrics that can be used to make other products such as jackets, shirts, pants, skirts, robes, dresses, hats, and other types of apparel that utilize textile fabrics that can be sewn into a finished garment, handbags, tote bags, luggage, overnight bags, duvet covers, comforters, shams, bed skirts, fitted and unfitted furniture covers for all types of furniture, tablecloths, placemats, napkins, window treatments, decorative throws, decorative pillows, toys, stuffed toys, laundry bags, diaper bags, laptop bags, cosmetic bags, soft furniture, and scarves.

Accordingly the process includes providing a first fabric panel comprising a first selected fiber, a second fabric panel comprising a second selected fiber and a batting panel comprising a third selected fiber. At least the first fabric panel is colored, e.g. piece dyed, yarn dyed, printed or otherwise pigmented in solid color or pattern and/or has some pigment applied in a finishing process as opposed to being in a griege goods state and/or the color was applied to the yarn prior to weaving, and at least the first selected fiber is susceptible to damage, e.g. fading and/or wear, by some aspect of washing, such as wetting and/or abrasion and/or heating. The selection of such a fiber which normally should not be washed, in a quilt which is washed, unexpectedly produces the useful result of the invention, namely the antique effect.

The process includes layering the three panels and stitching them along a stitch pattern to form a whole cloth quilt which is then washed in a wet bath and with heat and agitation to cause at least the first fabric panel to wear and fade and then drying the quilted fabric to form a quilt and/or quilted fabric with antique appearance.

The inventive process may also include the first and second selected fibers being susceptible to damage by wetting, wherein the first selected fiber includes cellulosic material, preferably rayon, lyocell or blends thereof.

The inventive process may also include providing the third selected fiber of the batting to be of a type which shrinks when heated and the washing step including heating the quilt sufficiently to shrink the batting and cause the pattern to contain puckers.

The inventive process may also include a washing step including heating the quilt to about 100 to 190 degrees Fahrenheit and agitating the quilt so that surfaces of at least the first fabric panel are rubbed against each other at least 50 times.

The antiquing effect of the present invention can be applied to any and all of the puffed sculpted or the puckered or the sculpted and puckered looks. The invention gives an antique appearance of worn and faded fabric to the sculptured look while retaining the puffed, sculptured features. This can be achieved, as will be explained in greater detail later in this disclosure, when polyester batting is used as there is no batting shrinkage forming puckering although there can be minor puckering due to the occasional shifting of the polyester batting within the stitch lines but this is much less puckering than with cotton batting and the whole cloth quilt fabric still retains the puffed, sculptured appearance. The antiquing effect of the present invention can also be applied to the current vintage process achieved by puckering, to improve and enhance the vintage qualities by adding the worn and faded features to the puckered effect.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
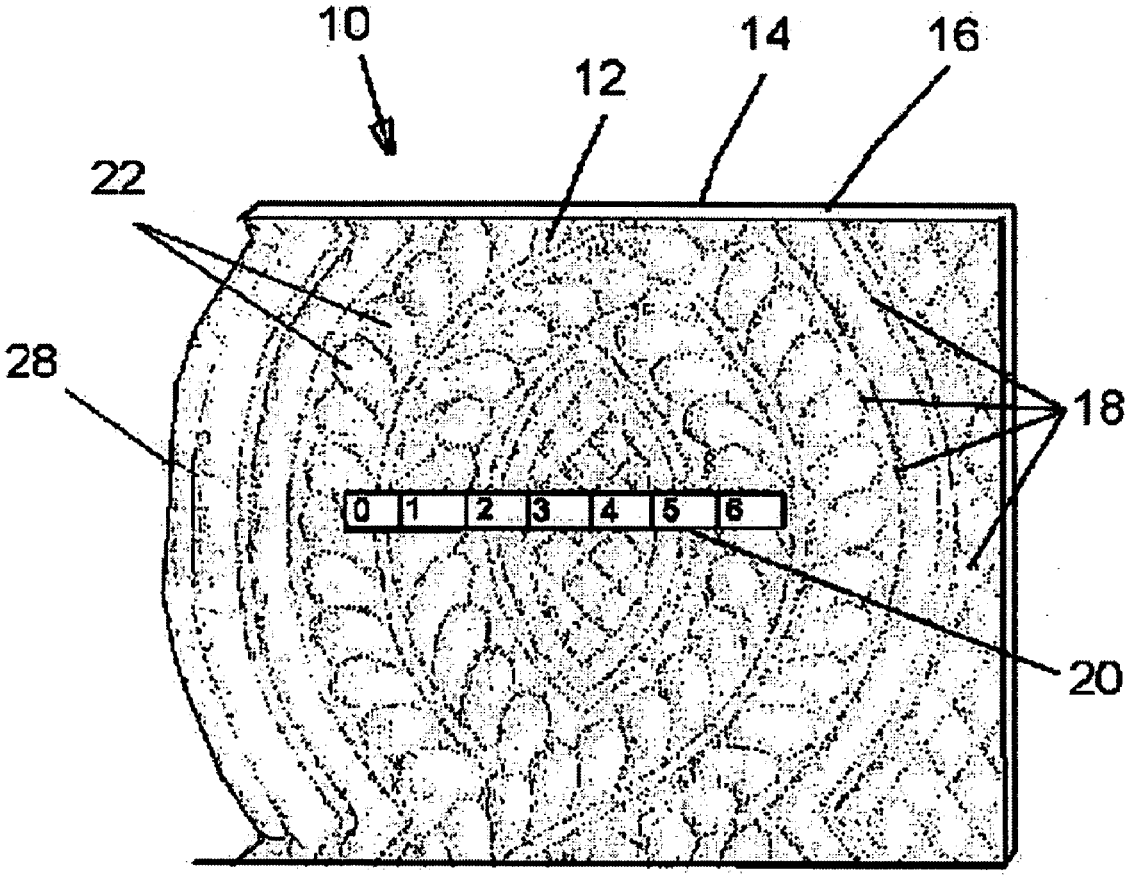
FIG. 1 is a schematic plan view of part of a whole cloth quilt of the invention that has been subjected to the process of the invention.

Referring to the drawings, FIG. 1 shows part of a whole cloth quilt 10, having a top fabric panel 12 meant generally to be viewed more often, a bottom fabric panel 14 generally meant to be viewed less than the top panel, intermediate batting 16, and a pattern of stitches 18 forming sculptured effects 22 and for connecting the three layers to each other. Special care is taken at the out edge 28 of the quilt 10 to insure that the surface panels 12 and 14 are directly engaged with each other along the outer edge to prevent any batting being visible at the edge, and to insure that the batting panel 16 is also secured to both surface panels.

Scale 20 having one inch increments shown, appears on quilt 10 in FIG. 1 to indicate the scale of the stitch pattern 18.

Top fabric panel 12 at least, and perhaps bottom fabric panel 14 also, is dyed, printed, pigmented or otherwise colored containing or carrying in a solid color or in a print or pattern. This characteristic of one or both surface fabrics, here simply called colored, can be vivid or bright or pale and has been applied to the griege goods or applied to the yarns before weaving and/or printed on a dyed or prepared-for-print fabric, before the quilt is washed, but is artificially faded by the inventive process as will be explained later.

The purpose of the invention is to achieve an antiqued finish on such whole cloth quilt fabrics. The antiqued effect is a worn and/or faded appearance of the top surface fabric 12 or of both surface fabrics 12 and 14 of the quilt.

Figure 2:
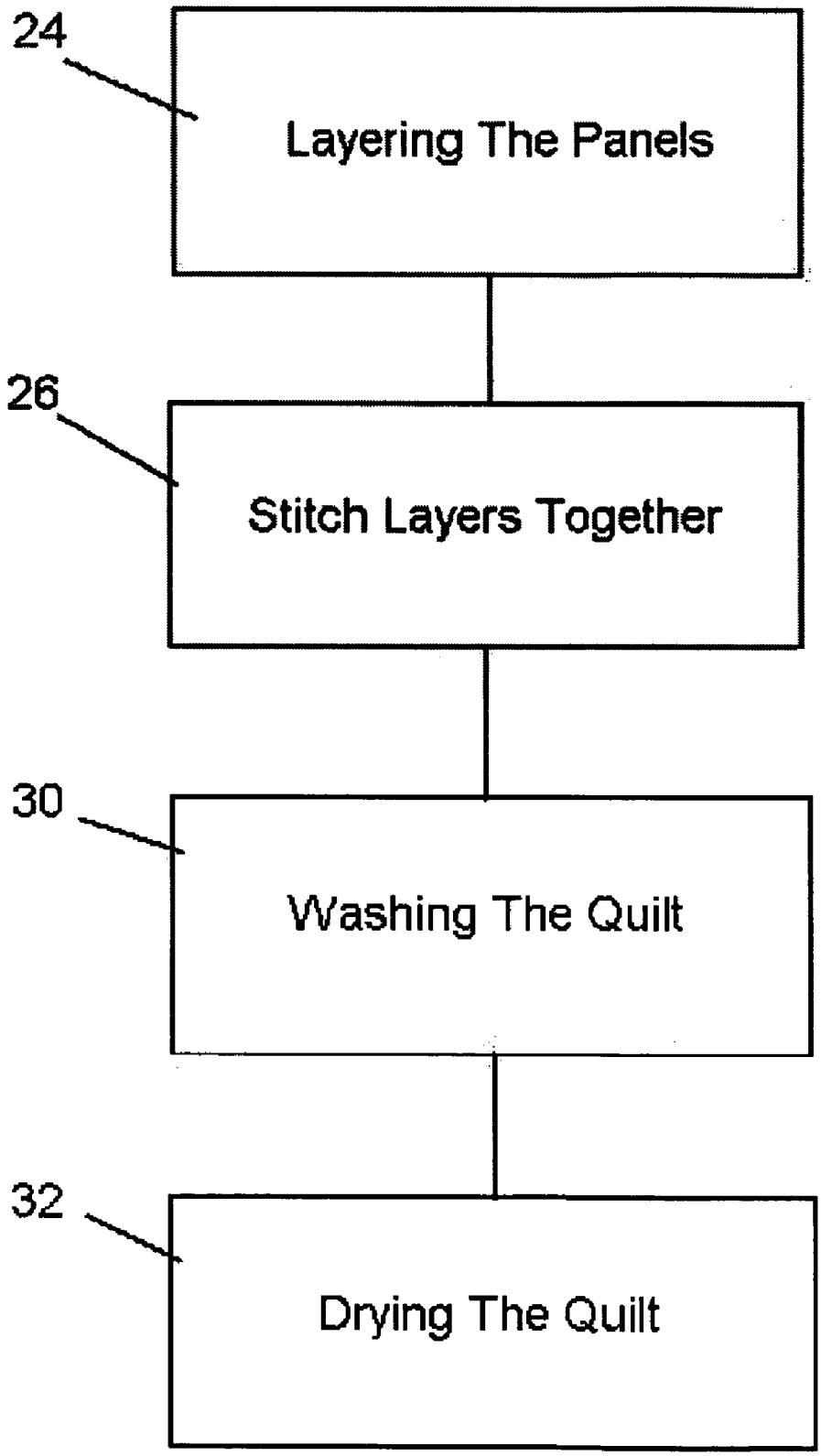
FIG. 2 is a flow chart illustrating the process of the present invention.

With references to FIG. 2, the process is as follows.

Step 1: The three panels 12, 16 and 14 are layered on each other, with the batting layer 16 between the top and bottom surface fabrics 12, 14 as shown in box 24 in FIG. 2.

Consideration 1—Fiber content of surface fabrics 12 and 14:

The following table gives the colorfastness, wet strength, abrasion resistance and dimensional stability properties of certain fibers subjected to commercial wash/dry cycles. Research by the inventor shows that the present invention works best with rayon and rayon blends that exhibit the damage properties to a satisfactory extent, namely they have very low wet strength and low abrasion resistance (causing wear) and largely due to the nature of the fiber and the dyes attraction to the fiber, the abrasion on the surface and the loss of the finish-sizing, among others, they are subject to fading during the laundering process. The types of dyes, the dye application methods and print methods that are used will also effect the loss of color. Although a high degree of shrinkage for the batting may also be useful to achieve puckering, the shrinkage property is not always needed or significant, depending on the type of appearance desired. In addition to rayon and rayon blends, lyocell, also a cellulosic fiber, and lyocell blends exhibit the faded and worn qualities. The lyocell fiber fibrillates when it is washed and agitated. This splintering of the fiber on random areas of the surface causes a faded and worn effect. The desired effect is most prevalent in lyocell fabrics that have not been chemically treated to prevent or reduce fibrillation.

TABLE 1

Fiber Properties related to this Invention

| | Colorfastness* | Wet Strength** | Abrasion Resistance*** | Dimensional Stability**** |
|---|---|---|---|---|
| NATURAL | | | | |
| Cellulosic | | | | |
| Cotton | Moderate | High | Moderate | Moderate |
| Linen | Moderate | High | Moderate | Moderate |
| Protein-based | | | | |
| Silk | Moderate | Low | Moderate | Low |
| Wool | Moderate | Low | Moderate | Low |
| Cellulosic | | | | |
| ManMade | | | | |
| Viscose Rayon | Moderate | Low | Low | Low |
| Lyocell | Moderate | Moderate | Low | Moderate |
| Acetate | Moderate | Moderate | Moderate | Moderate |

TABLE 1-continued

| Fiber Properties related to this Invention | | | | |
|---|---|---|---|---|
| | Colorfastness* | Wet Strength** | Abrasion Resistance*** | Dimensional Stability**** |
| SYNTHETIC | | | | |
| Polyester | Moderate | High | High | High |
| Nylon | Moderate | High | High | High |
| Acrylic | High | High | Moderate | High |

Definition of Properties-
Colorfastness* The resistance of a dyed and/or printed fabric to fading, in this case during commercial laundering.
Wet Strength** The strength of a fabric when it is saturated with water, in this case during commercial laundering.
Abrasion Resistance*** The ability of a fiber or fabric to withstand surface wear and rubbing, in this case during commercial laundering.
Dimensional Stability**** The ability of a fabric to maintain its original width and length and configuration, in this case during commercial laundering.

TABLE 2

These results were obtained after 1 time through the commercial wash/dry process described in the application. Although the effects increase after each time processed, the change is much less significant after the first time. The process of the invention can achieve the desired results through up to 10 wash/dry cycles while prior art quilts and methods achieve some antiquing effect only after 20 or more wash/dry cycles.

QUILTED FABRIC TEST RESULTS

| Smp | Average Water Temp | Quilt Top Fiber | Quilt Bottom Fiber | Quilt Batting Fiber | Quilt top Length Shrinkage % | Quilt top Width Shrinkage % | Quilt Top Fade Grade | Quilt Top Wear Grade | Quilt Top Surface Dimension Grade |
|---|---|---|---|---|---|---|---|---|---|
| 1 | 140 | Rayon | Rayon | Cotton | −6.98 | −13.95 | 2 | 3 | 4 |
| 2 | 140 | Rayon | 60S/40R | Cotton | −6.98 | −11.63 | 2 | 3 | 3–4 |
| 3 | 140 | Rayon | Linen | Cotton | −4.65 | −6.98 | 2 | 3 | 4 |
| 4 | 140 | Rayon | Rayon | Poly | −4.65 | −6.98 | 2 | 3 | 2 |
| 5 | 140 | Bemberg | Bemberg | Cotton | −4.65 | −6.98 | 2 | 4 | 4 |
| 6 | 140 | Bemberg | Bemberg | Poly | −4.65 | −6.98 | 2 | 4 | 1 |
| 7 | 140 | Rayon | 50R/50L | Cotton | −6.98 | −9.30 | 3 | 3 | 4 |
| 8 | 140 | 50R/50L | Rayon | Cotton | −9.30 | −9.30 | 3 | 4 | 5 |
| 9 | 140 | Rayon | 85L/15R | Cotton | −6.98 | −13.95 | 2 | 3 | 4 |
| 10 | 140 | 85L/5R | Rayon | Cotton | −4.65 | −13.95 | 2 | 4 | 4 |
| 11 | 140 | 50R/50L | 50R/50L | Poly | −11.63 | −2.33 | 4 | 4 | 2 |
| 12 | 140 | Rayon | Silk | Cotton | −6.98 | −4.65 | 2 | 4 | 4 |
| 13 | 140 | Rayon | Silk | Cotton | −9.30 | −6.98 | 2 | 2 | 4 |
| 14 | 140 | Rayon | 52C/48R | Poly | −4.65 | −11.63 | 2 | 3 | 1 |
| 15 | 140 | Linen | Rayon | Cotton | −6.98 | −6.98 | 1 | 2 | 3–4 |
| 16 | 140 | Cotton | Rayon | Cotton | −4.65 | −4.65 | 1 | 1 | 4 |
| 17 | 140 | Cotton | Cotton | Cotton | −4.65 | −6.98 | 1 | 1 | 4 |
| 18 | 140 | Linen | Linen | Cotton | −6.98 | −4.65 | 2 | 2 | 5 |
| 19 | 140 | Silk | Rayon | Cotton | −6.98 | −9.30 | 1 | 1 | 4 |
| 20 | 140 | 60S/40R | 60S/40R | Poly | −4.65 | −4.65 | 2 | 2 | 1 |
| 21 | 140 | 60S/40R | 60S/40R | Cotton | −4.65 | −6.98 | 2 | 2 | 4 |
| 22 | 140 | 85R/15L | 50R/50P | Cotton | −4.65 | −4.65 | 3 | 3 | 2 |
| 23 | 140 | 50R/50P | 85R/15L | Cotton | −2.33 | −2.33 | 2 | 4 | 4 |
| 24 | 140 | Silk | Silk | Cotton | −6.98 | −13.95 | 1 | 2 | 4 |
| 25 | 140 | Silk | Silk | Cotton | −9.30 | −6.98 | 1 | 1 | 4 |
| 26 | 140 | Silk | Rayon | Cotton | −6.98 | −11.63 | 1 | 2 | 3 |
| 27 | 140 | 85C/15R | Cotton | Cotton | −4.65 | −6.98 | 2 | 3 | 4 |
| 28 | 140 | Cotton | 85C/15R | Cotton | −4.65 | −6.98 | 1 | 1 | 4 |
| 29 | 140 | 50R/50P | 50R/50P | Poly | −6.98 | −11.63 | 2 | 3 | 1 |
| 30 | 140 | 50R/50P | 50R/50P | Cotton | −9.30 | −11.63 | 2 | 3 | 3 |
| 31 | 140 | 85C/15R | Rayon | Cotton | −6.98 | −11.63 | 2 | 4 | 4 |
| 32 | 140 | 52C/48R | Cotton | Cotton | −4.65 | −6.98 | 2 | 2 | 4 |
| 33 | 140 | 52C/48R | Rayon | Poly | −4.65 | −11.63 | 2 | 4 | 1 |
| 34 | 140 | 52C/48R | Rayon | Cotton | −4.65 | −11.63 | 2 | 4 | 4 |
| 35 | 140 | 70S/30R | Rayon | Cotton | −6.98 | −11.63 | 2 | 3 | 3 |
| 36 | 140 | 80R/20W | 80R/20W | Cotton | −6.98 | −6.98 | 2 | 4 | 4 |
| 37 | 140 | 80R/20W | 80R/20W | Poly | −6.98 | −6.98 | 2 | 4 | 2 |
| 38 | 140 | Wool | Wool | Cotton | −11.63 | −6.98 | 1 | 2 | 4 |
| 39 | 140 | Wool | Wool | Poly | −11.63 | −6.98 | 1 | 2 | 1 |
| 40 | 140 | Acetate | Acetate | Cotton | −6.98 | −2.33 | 2 | 1 | 3 |
| 41 | 140 | Acetate | Acetate | Poly | −2.33 | −2.33 | 2 | 1 | 2 |

TABLE 2-continued

These results were obtained after 1 time through the commercial wash/dry process described in the application. Although the effects increase after each time processed, the change is much less significant after the first time. The process of the invention can achieve the desired results through up to 10 wash/dry cycles while prior art quilts and methods achieve some antiquing effect only after 20 or more wash/dry cycles.

QUILTED FABRIC TEST RESULTS

| Smp | Average Water Temp | Quilt Top Fiber | Quilt Bottom Fiber | Quilt Batting Fiber | Quilt top Length Shrinkage % | Quilt top Width Shrinkage % | Quilt Top Fade Grade | Quilt Top Wear Grade | Quilt Top Surface Dimension Grade |
|---|---|---|---|---|---|---|---|---|---|
| 42 | 140 | Lyocell | Lyocell | Cotton | −2.33 | 0 | 2 | 3 | 4 |
| 43 | 140 | Lyocell | Lyocell | Poly | −2.33 | −2.33 | 2 | 3 | 2 |
| 44 | 140 | Acrylic | Acrylic | Cotton | −2.33 | −2.33 | 1 | 2 | 4 |
| 45 | 140 | Acrylic | Acrylic | Poly | 0 | 0 | 1 | 2 | 2 |
| 46 | 140 | Lyocell | Lyocell | Cotton | −2.33 | −2.33 | 2 | 3 | 4 |
| 47 | 140 | Lyocell | Lyocell | Cotton | −2.33 | −2.33 | 2 | 3 | 4 |
| 48 | 140 | 60L/40R | 60L/40R | Cotton | −4.65 | −4.65 | 2 | 3 | 4 |

Tests were conducted to determine the fading, wear and surface dimension of quilted fabrics. The AATCC-American Association of Textile Chemists and Colorists test methods were used as guidelines for conducting these tests to obtain accurate and reliable results, specifically, AATCC Test Method 61-2003.

Colorfastness to Laundering, Home and Commercial: Accelerated and AATCC Test Method 96-2001 Dimensional Changes in Commercial Laundering of Woven and Knitted Fabrics except Wool. These AATCC tests are not meant to be used for quilted fabrics and the Colorfastness test is an accelerated test. They have been used as guidelines only, to provide the best possible procedures considering the differences in their usage with this test.

The quilted samples were sewn 8"×8" consisting of a top fabric, bottom fabric and inner layer of batting. The squares were sewn in a grid quilt pattern using ½", 1" and 1½" spacing of the quilt lines to provide variation in distances between the quilt lines. Bench mark lines made with a template were drawn with a marking pen on each side of the quilted sample to be later used for measuring quilt shrinkage.

Samples were laundered in a commercial washer on Cotton/Sturdy cycle at a temperature of about 140 degrees F. The samples were washed together at one time so that the load weighed about 3 lbs to provide sufficient friction of fabrics against each other. A detergent was used in an amount indicated for normal washing that is similar in content to the AATCC Standard Reference Detergent—Without Optical Brighteners—so that it would not interfere with the color change. The total running time of the washing was about 30 minutes including wash cycle and fill time.

The quilted samples were dried in a commercial dryer—Tumble Dry—Cotton/Sturdy cycle at about 160 degrees F. for about 30 minutes until all samples were completely dry, with the cotton batting samples taking longer than the polyester batting samples to dry.

The samples were then graded on a 1–5 scale compared to the control samples that were not laundered.

Grading System:

Fade—Degree of Color Change

1—No change in color

2—Minimal change in color

3—Moderate change in color

4—Heavy change in color

5—Very Heavy change in color.

Wear—Surface Attributes—One or More of: short fiber ends, hairy, uneven thinning, irregular texture, scoffed, and stippled 1—No change in surface fibers 2—Minimal change in surface fibers 3—Moderate change in surface fibers 4—Heavy change in surface fibers 5—Very Heavy change in surface fibers.

Surface Dimension—Contours of the surface fabrics

1—Full, puffed surface

2—Slight puffed surface

3—Moderately flat surface

4—Moderate dense, rippled surface

5—High dense, rippled surface.

The natural fibers of cotton and linen in their pure form (not blended with rayon) have high wet strength and therefore are not susceptible to fade or wear during the washing process. Pure silk, although it has low wet strength, has medium or moderate abrasion resistance in most of its forms and will show almost no fading or wear during the washing process. The wool tested showed little wear or fading.

Fabrics with blends of the natural fibers and rayon or lyocell, all showed a degree of wear and fading to be included in this invention. The same holds for the synthetic fibers. In their pure form, polyester, nylon and acrylic have a high wet strength and therefore cannot be included in this invention. When they are blended with rayon or lyocell, they exhibit degrees of wear and fading on the surface. The minimum amount of rayon or lyocell that needed to be part of the blend for all the fabrics, both natural and synthetic, was 15%, or from 10% to 100% by weight, as a preferred range. In addition, it did not matter if the blended fabric was made from blended yarns or if the fabric was made from a pure fiber warp or weft woven in combination with a pure rayon or lyocell warp or weft.

Also, within the designated fiber types, rayon and rayon blends, the degree of wear and fading was related to the way the fibers were spun into yarn, the type of weave and the finishing of the fabrics. Staple fibers, looser weaves, jacquard weaves and minimal finishing resulted in more wear and fading than longer filament yarns, tight weaves, plain weaves, and heavy finishing processes. However, all rayon and rayon blended fabrics showed wear and fading within the grade ranges specified in Table 2.

The surface dimension was strongly related to the batting fiber. The cotton batting produced a rippled surface and the polyester batting a smoother, puffed surface. The type of batting did not effect the wear or fading of the surface fabrics.

Since the rippled surface is often viewed as a vintage look, this invention will improve and enhance that process. In addition, this invention will also provide a method for antiquing for those who Want to retain the puffed, sculptured look that can be caused by polyester batting stitched in whole cloth quilted fabric.

Other cellulosic fibers in addition to rayon and lyocell may also work to achieve the desired extent of antiquing.

Rayon is a manufactured but non-synthetic fiber.

There are three different types of rayon for apparel and home textiles. The most dominant form, with the largest market share, is called "regular rayon" or "viscose." It is the regular or viscose rayon that is produced in the most widespread production process that has the properties most applicable to the present invention. The main reasons are that when wet, the rayon fibers are very weak and can break down at the surface when abrasion is applied during the washing process. Also, the fabric loses its luster, sheen and a degree of color, usually from the loss of the sizing that is used in the finishing of the fabric, the nature of the fibers and the effect of abrasion on the surface. Also, the low dimensional stability during washing can contribute to an irregular texture on the fabric surface which has a distressed effect.

The two other types of rayon are produced in relatively much smaller quantities—HWM and Cupramonium rayon. HWM can be machine washed and dried and has high wet strength. It is frequently called "polynosic." Cupramonium rayon has similar properties to regular, viscose rayon, and can be included in this invention. Cupramonium rayon is often referred to under the trademark name of "Bemberg". 100% Bemberg rayon was included in the test and showed comparable results to the regular, viscose rayon.

The object in any case is to select a fabric which contains at least some fiber that is susceptible to damage by some aspect of washing such as wetting and/or agitation, so that the fiber fades or appears worn after washing. The fiber selected thus is of a type which, counter-intuitively, should not be washed, but which the inventor has discovered produces a new, advantageous and unexpected result, namely an attractive vintage or antiqued appearance.

According to the present invention the word "damage" means fading or wear or other distress caused by some aspect of washing, such as but not limited to wetting and agitation.

Consideration 2—Fiber content of batting:

100% Cotton and 100% polyester batting was tested.

Weight of the cotton batting was 200 grams per square meter with batting shrinkage of 3–5%. Cotton batting for this invention will have an average range from about 150–270 grams per square meter but it can be lighter or heavier. The polyester used in the testing was low loft. Both high loft and low loft polyester and any loft of polyester can be used for this invention. Polyester does not shrink and generally causes a lightweight, smooth, puffy surface. The polyester retains the sculptured effect of the quilt pattern of the whole cloth quilted fabric. Although much rarer, wool batting can be used, and the wool batting that is resin bonded can be machine washed and dried without shrinkage, causing a similar appearance to the polyester. The wool batting provides warmth and is lightweight. Wool batting can be used in whole cloth quilted fabric in this invention. Also, silk or rayon or lyocell batting can be used for this invention. Blended fibers such as cotton and polyester blended can be used as batting in addition to any combination of the aforementioned batting fibers.

The choice of batting for a quilt or quilted fabric is generally determined by these factors: use of the quilt or quilted fabric, whether it is needed for warmth, desired fiber-natural or synthetic, whether done by machine or hand, distance of stitch lines, and appearance. The type of batting fiber and how it is processed affects its performance during and after the quilting process. Most quilt batting is made with a bonding or a needle-punched process, and either process will produce the desired effect. Batting that is plain or garneted will require the quilt lines stitching in any pattern to be closer together, generally ¼ to 1 inch apart, to prevent bunching or shifting. This applies to all quilts not only to whole cloth quilts or whole cloth quilts with the antiquing process of the present invention.

Based on the inventor's research, both cotton batting and polyester batting work for the invention. The surface effects are different but both can be antiqued to the desired appearance. If a "rippled effect" or puckering is also desired in addition to the antiquing, then batting susceptible to shrinkage (meaning cotton or the like, and not polyester) is used. Also, wool, silk, rayon, lyocell and any combination of the fibers can be used.

Step 2: The three layers are stitched together by hand or machine with stitching across the surface of the fabrics, illustrated by box 26 in FIG. 2.

The edges of the quilt at 28 in FIG. 1, must be finished so that the top and bottom panels 12, 14 are joined together with batting also attached but enclosed between the top and bottom layers so that no batting is visible at the edge.

Consideration 1—Length of the stitches:

Not less than 6 stitches per inch should be used. An average number of stitches is 10 to 14 stitches per inch and generally 6 to 21 can work with the invention or a higher number based on machine used. The maximum amount must be less than would cause gathering of fabric around the stitch line. If machine stitched, tension must be adjusted so that stitching 18 is smooth.

Consideration 2—Fiber content of the thread used for stitching:

Cotton thread was used for the test because in general, the thread type should match the fiber content and cotton thread is generally used with cottons, linens, rayons as they are cellulosic and even silks, when silk thread is not available. However, polyester thread can be used in this invention with no anticipated problems, but is not advisable due to the above.

Consideration 3—Distance between the patterns being stitched:

The closer together the stitch lines 18 in any pattern, the more defined the pattern on the surface fabric 12 as the batting 16 is in a more confined space. Therefore, the stitch lines can be next to each other or apart from each other with the average distance ¼ to 2 inches. Going beyond 4 square inches of space without stitching will diminish the fullness of the sculptured effect because the batting has more space between stitch lines but is still a viable part of this patent application. The distance between the stitch lines in any pattern does not affect the wear or fading of the fabric.

Step 3: Washing of the quilt, at 30 in FIG. 2.

The quilt is washed in a commercial washer or can be washed by hand in a temperature ranging from 100 to 190 degrees Fahrenheit. The machine washing cycle is heavy or the longer wash cycle with the most agitation—with the agitator causing abrasion on the wet fabric. If washed by hand, the surface of the fabric must be rubbed against itself a minimum of 50 times. This amount of agitation automatically takes place for machine washing.

Testing has confirmed the water temperature and best range.

Step 4: Drying of the quilt, at 32 in FIG. 2.

The quilt is machine dried in a commercial dryer on the warm/hot setting.

ADVANTAGES OF THE INVENTION

The antique or vintage look has gained in popularity as consumers desire items that have a nostalgic feeling. The yearning for products that appear aged by time is a trend that many say will only grow, particularly as the Baby Boomer generation continues to mature. In addition, decorating with antiques and distressed furniture has also increased in popularity and this invention fits and enhances that decorating style and can be a useful product for consumers with that decorating preference. The worn, faded and rippled surface on a whole cloth quilt offers a vintage appeal to a product that has a long history in the United States. It provides a much more authentic vintage look over current processes. The current process provides a puckered look, but the fabric itself can still look new. This invention is an improvement over that process because it also gives an antique appearance to the fabric which makes the item appear more authentically vintage. The invention also allows for different types of surface effects—including the original sculptured, outlined look, depending on the fiber content of and the batting.

Figure 3:
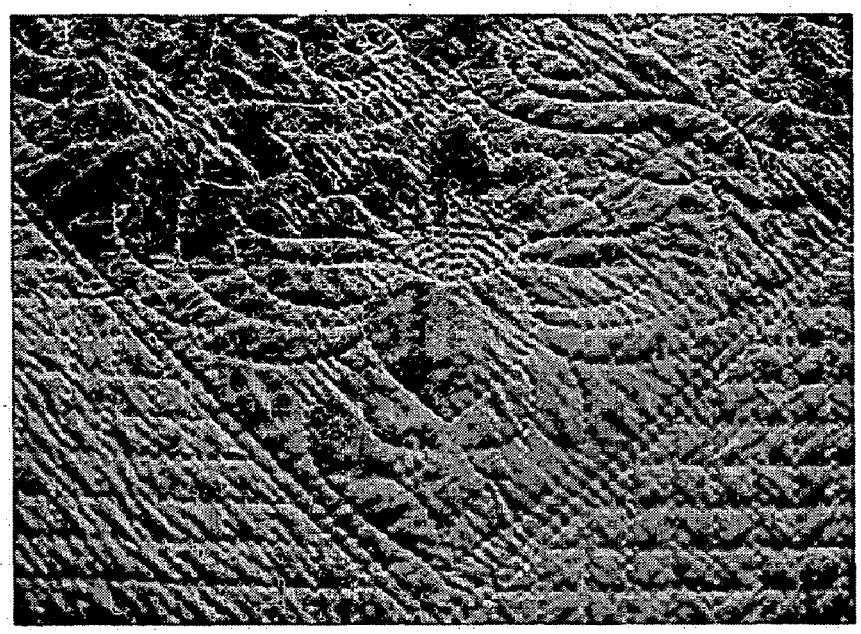
FIG. 3 is a representation of part of a whole cloth quilt of the present invention which better illustrates the puckering effect.
Figure 4:
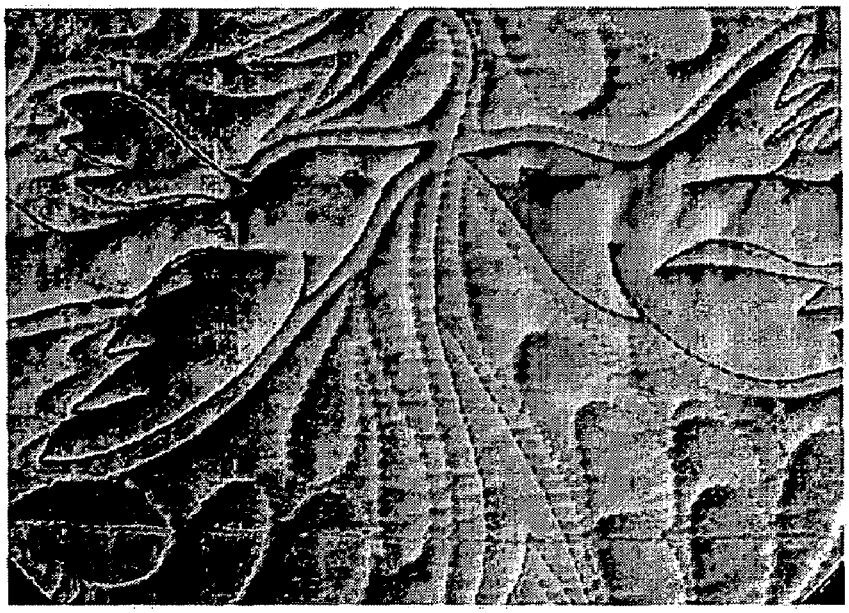
FIG. 4 is a representation of part of a whole cloth quilt of the present invention which better illustrates the sculpturing effect.
Figure 5:
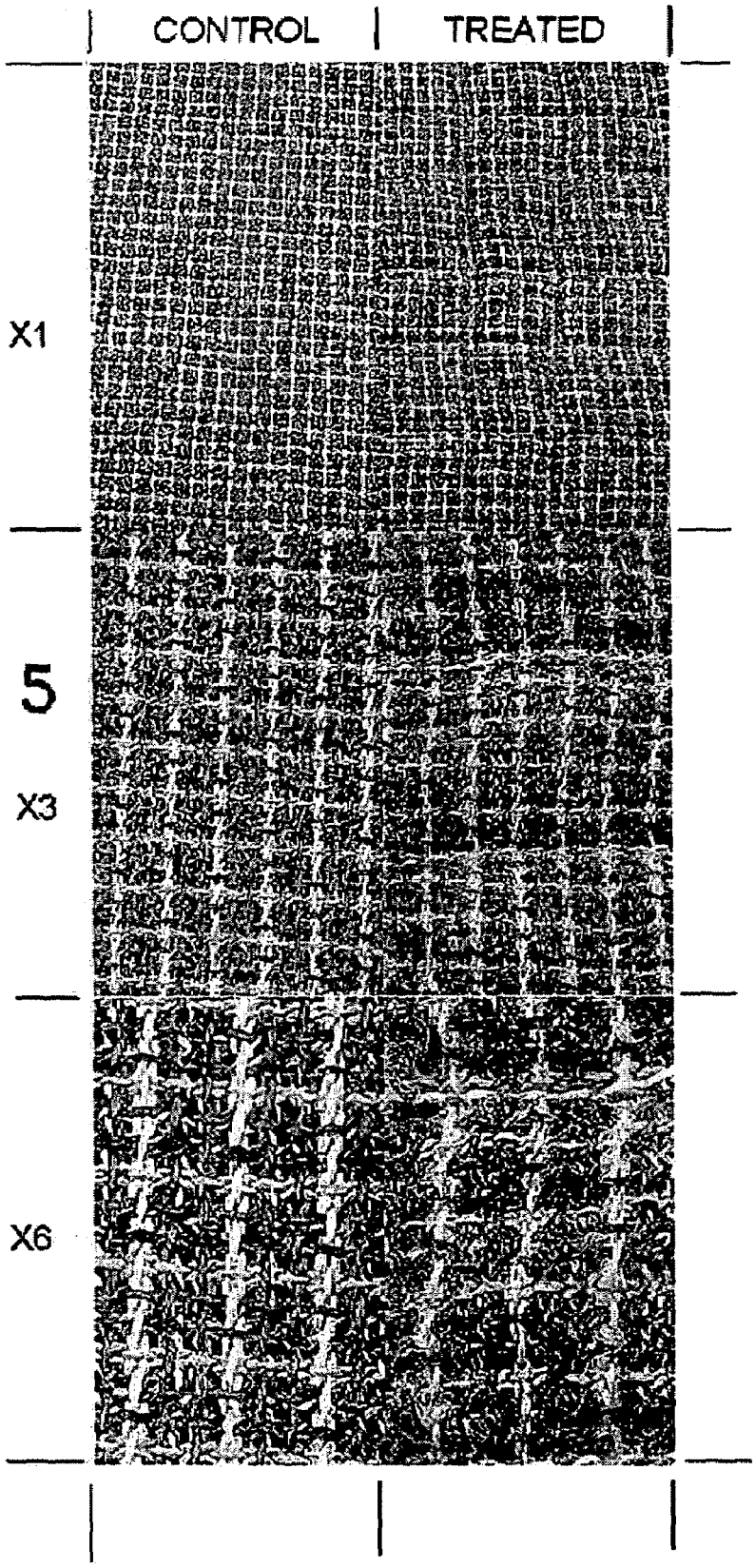
FIG. 5 is a composite representation of a control fabric next to a treated fabric according to the present invention, in actual size at the top and in two magnifications at the center and bottom, to illustrate the advantageous effects of the invention.

FIG. 3 illustrates the puckering effect of a whole cloth quilt of the present invention and FIG. 4 illustrates the puffed, sculptured effect. FIG. 5, upper left section is an actual size image of a quilt of the present invention before it has been subjected to the treatment according to the present invention. The upper right section of FIG. 5 is an actual size image of the quilt after treatment to show the antiqued effect. The middle left and right sections show the same respective control and treated quilts at three times magnification (×3) while the bottom left and right sections show the control and treated quilt images at six times magnification (×6).

While a specific embodiment of the invention has been shown and described in detail to illustrate the application of the principles of the invention, it will be understood that the invention may be embodied otherwise without departing from such principles.

What is claimed is:

1. A process for antiquing a quilt comprising:

providing a first fabric panel comprising a first selected fiber;

providing a second fabric panel comprising a second selected fiber;

providing a batting panel comprising a third selected fiber;

at least the first fabric panel being colored and at least the first selected fiber being susceptible to damage by washing;

layering the batting panel between the first and second fabric panels;

stitching the first fabric panel, the second fabric panel and the batting panel together using thread comprising a fourth selected fiber and along a stitch pattern to form a whole cloth quilt;

washing the whole cloth quilt in a wet bath and with heat and agitation to cause at least the first fabric panel to wear and fade; and drying the washed whole cloth quilt to form a quilt with antique appearance.

2. A process according to claim 1, wherein the first and second selected fibers are susceptible to damage by wetting.

3. A process according to claim 1, wherein the first selected fiber includes cellulosic material.

4. A process according to claim 1, wherein the first selected fiber includes at least one of rayon and a rayon blend.

5. A process according to claim 1, wherein the first selected fiber includes at least one of lyocell and a lyocell blend.

6. A process according to claim 1, wherein the third selected fiber of the batting shrinks when heated and the washing step includes heating the quilt sufficiently to shrink the batting and cause the pattern to include puckers.

7. A process according to claim 1, wherein the third selected fiber of the batting includes cotton and shrinks when heated and the washing step includes heating the quilt sufficiently to shrink the batting and cause the pattern to include puckers.

8. A process according to claim 1, wherein the washing step includes heating the quilt to above about 100 degrees Fahrenheit, agitating the quilt so that surface of the fabric panels are rubbed against each other at least about 50 times, and the washing step being performed only up to 10 times.

9. A process according to claim 1, wherein the third selected fiber of the batting includes polyester and does not shrink when heated during the washing step.

10. A process according to claim 1, wherein the batting panel is made with at least one of a bonding and a needle-punched process, and lines of stitching of the stitch pattern are about ¼ to 2 inches apart.

11. A process according to claim 1, wherein the stitching is performed with not less than about 6 stitches per inch.

12. A process according to claim 1, wherein the first selected fiber includes about 10 to 100% rayon by weight.

13. A process according to claim 1, wherein at least one of the first and second fabric panels are made of at least one of: staple fiber; loose weave; jacquard weave; and low finish fabric.

14. A whole cloth quilt with antique appearance made by the process comprising:

providing a first fabric panel comprising a first selected fiber;

providing a second fabric panel comprising a second selected fiber;

providing a batting panel comprising a third selected fiber;

at least the first fabric panel being colored and at least the first selected fiber being susceptible to damage by washing;

layering the batting panel between the first and second fabric panels;

stitching the first fabric panel, the second fabric panel and the batting panel together using thread comprising a fourth selected fiber and along a stitch pattern to form a whole cloth quilt;

washing the whole cloth quilt in a wet bath and with heat and agitation to cause at least the first fabric panel to wear and fade; and drying the washed whole cloth quilt to form a quilt with antique appearance.

15. The whole cloth quilt according to claim 14, wherein the first and second selected fibers are susceptible to damage by wetting.

16. The whole cloth quilt according to claim 14, wherein the first selected fiber includes cellulosic material.

17. The whole cloth quilt according to claim 14, wherein the first selected fiber includes at least one of rayon and a rayon blend.

18. The whole cloth quilt according to claim 14, wherein the first selected fiber includes at least one of lyocell and a lyocell blend.

19. The whole cloth quilt according to claim 14, wherein the third selected fiber of the batting shrinks when heated and the washing step includes heating the quilt sufficiently to shrink the batting and cause the pattern to include puckers.

20. The whole cloth quilt according to claim 14, wherein the third selected fiber of the batting includes cotton and shrinks when heated and the washing step includes heating the quilt sufficiently to shrink the batting and cause the pattern to include puckers.

21. The whole cloth quilt according to claim 14, wherein the washing step includes heating the quilt to above about 100 degrees Fahrenheit, agitating the quilt so that surface of the fabric panels are rubbed against each other at least about 50 times, and the washing step being performed only up to 10 times.

22. The whole cloth quilt according to claim 14, wherein the third selected fiber of the batting includes polyester and does not shrink when heated during the washing step.

23. The whole cloth quilt according to claim 14, wherein the batting panel is made with at least one of a bonding and a needle-punched process, and lines of stitching of the stitch pattern are about ¼ to 2 inches apart.

24. The whole cloth quilt according to claim 14, wherein the stitching is performed with not less than about 6 stitches per inch.

25. The whole cloth quilt according to claim 14, wherein the first selected fiber includes about 10 to 100% rayon by weight.

26. The whole cloth quilt according to claim 14, wherein at least one of the first and second fabric panels are made of at least one of: staple fiber; loose weave; jacquard weave; and low finish fabric.

* * * * *